US005809446A

United States Patent [19]

Visser

[11] Patent Number: 5,809,446

[45] Date of Patent: Sep. 15, 1998

[54] INSTRUMENT FOR MEASURING FUEL INJECTION TIME

[75] Inventor: Jacobus C. Visser, Almelo, Netherlands

[73] Assignee: Fluke Corporation, Everett, Wash.

[21] Appl. No.: 701,905

[22] Filed: Jul. 16, 1996

[51] Int. Cl.[6] ..... G06G 7/70

[52] U.S. Cl. ..... 701/103; 701/102; 701/104; 701/105

[58] Field of Search ..... 701/101, 102, 701/103, 104, 105, 114; 123/478, 492, 458, 357, 480, 486, 479, 198 D, 467, 506, 531, 501, 502, 427; 73/117.3, 119 A

[56] References Cited

U.S. PATENT DOCUMENTS

| | | | |
|---|---|---|---|
| 4,173,030 | 10/1979 | Rabe | 361/154 |
| 4,359,032 | 11/1982 | Ohie | 123/458 |
| 4,541,380 | 9/1985 | Oshizawa et al. | 123/357 |
| 4,586,479 | 5/1986 | Isomura et al. | 123/492 |
| 4,777,921 | 10/1988 | Miyaki et al. | 123/456 |
| 4,889,100 | 12/1989 | Nakaniwa et al. | 123/492 |
| 4,911,131 | 3/1990 | Nakaniwa et al. | 123/492 |
| 4,911,132 | 3/1990 | Nakaniwa et al. | 123/492 |
| 4,980,845 | 12/1990 | Govekar | 701/33 |
| 5,243,947 | 9/1993 | Yamamoto et al. | 123/458 |

OTHER PUBLICATIONS

Willam B. Ribbens: Understanding Automotive electronics, 4th edition, Jan. 1992.

*Primary Examiner*—Jacques H. Louis-Jacques
*Attorney, Agent, or Firm*—George T. Noe

[57] ABSTRACT

A test instrument for measuring the injection time of different types of electronic fuel injectors in a fuel injected engine is provided. The test instrument is coupled to receive an injection signal from any of a variety of fuel injector types and over a range of injection times and repetition rates. The injection signal is digitally sampled and stored in memory. The injection time is determined according to an algorithm executed by a microprocessor which operates on the stored injection signal to determine first and second edges, with the time difference between the first and second edges representing the injection time. The second edge must be followed by the injection signal being substantially equal to the battery voltage for a predetermined hold time in order to reject false edges occurring before the second edge.

17 Claims, 7 Drawing Sheets

INSTRUMENT FOR MEASURING FUEL INJECTION TIME

BACKGROUND OF THE INVENTION

This invention relates generally to automotive electrical test instruments and in particular to a test instrument for measuring the fuel injection time of any of a variety of electrical fuel injectors.

Fuel injectors have largely replaced carburetors in gasoline engines in automotive applications. Electronic fuel injection systems employ solenoid-operated fuel injectors that depend on an electrical signal to open and close a fuel valve. Several types of fuel injection systems currently exist including monopoint and multipoint systems. Monopoint systems employ one fuel injector for all cylinders of the engine. Multipoint systems employ a fuel injector of each of the cylinders of the engine.

A typical solenoid-operated fuel injector operates by energizing the solenoid coil according to an injection pulse to lift a needle valve so that fuel can flow through to create the fuel injection. The duration of the fuel injection is adjusted depending on the engine parameters, including intake airflow and engine speed, to produce a desired power output.

In the service and maintenance of fuel injected engines, test instruments are called upon to determine the duration of the fuel injection, commonly called the injection time, using the electrical signal measured across the fuel injector. Measuring the injection time is made more difficult by the fact that a number of different types of fuel injectors exist that create different types of fuel injection signals. Therefore, it would be desirable to provide a test instrument for measuring the injection time in any of the variety of the known types of fuel injectors.

SUMMARY OF THE INVENTION

In accordance with the present invention, a test instrument for measuring the injection time of different types of electrical fuel injectors is provided. The test instrument is coupled to receive an injection signal from any of a variety of known types of fuel injectors and over a range of injection times and repetition rates. The injection signal is digitally sampled and stored in memory. The first edge is defined as a negative going transition exceeding the predetermined step size. The second edge is defined as positive going transition exceeding the predetermined step size and followed by a voltage level substantially equal to the battery voltage Vbatt exceeding a hold time. The injection time is the time difference between the first and second edges and is determined according to an algorithm executed by a microprocessor which operates on the stored injection signal. False edges that occur before the second edge as generated by some types of fuel injectors are rejected because the voltage level is not substantially equal to the battery voltage for a predetermined hold time.

One object of the present invention is to provide a test instrument for determining the injection time of a fuel injector.

Another object of the present invention is to provide a test instrument for determining the injection time of any of a set of different fuel injector types.

An additional object of the present invention is to provide a method for determining the injection time from a fuel injection signal by determining first and second edges while rejecting false edges.

Other features, attainments, and advantages will become apparent to those skilled in the art upon a reading of the following description when taken in conjunction with the accompanying drawings.

DETAILED DESCRIPTION OF THE INVENTION

Figure 1:
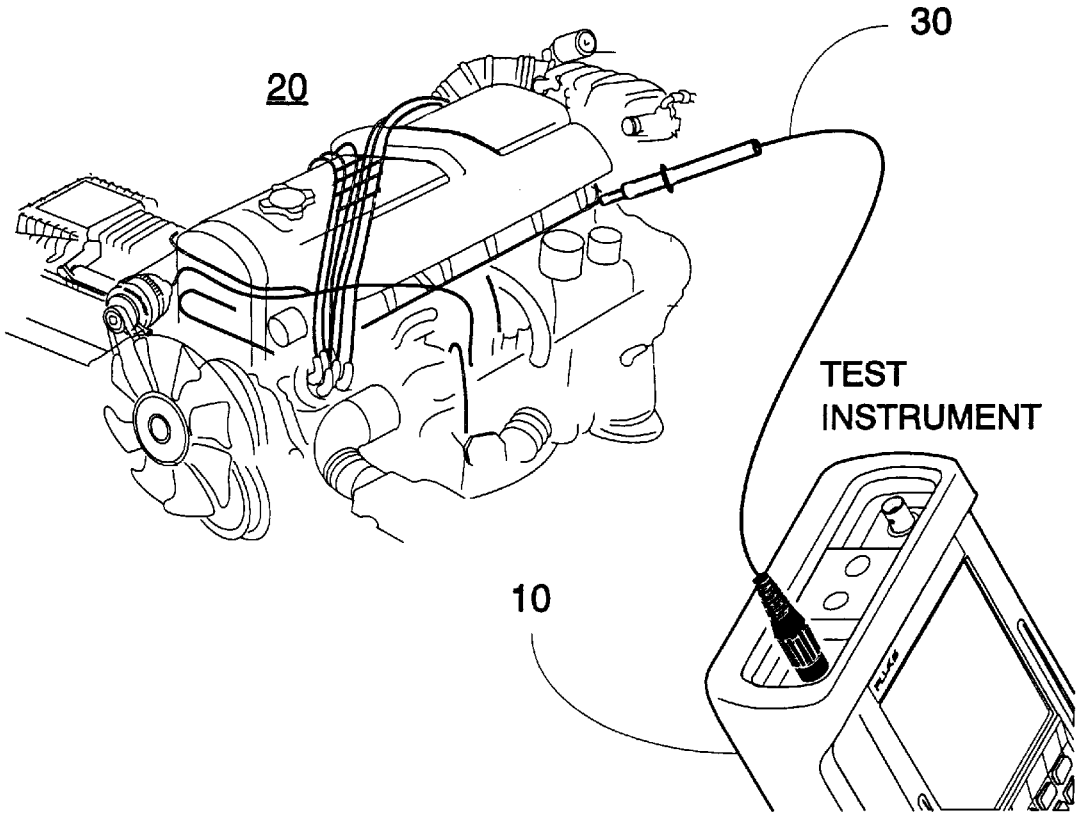
FIG. 1 is a drawing (not to scale) illustrating the application of a test instrument according to the present invention to a fuel-injected internal combustion engine.

FIG. 1 illustrates the application of a test instrument 10 operating according to the present invention. The test instrument 10 is coupled to a fuel-injector in a fuel-injected engine 20 by a voltage probe 30. The fuel-injected engine 20 has an electronic fuel injection system that may have only one fuel injector, as in a monopoint fuel injection system or the fuel-injected engine 20 may have a multipoint fuel injection system, typically with one fuel injector per cylinder. In the service and maintenance of the fuel-injected engine 20, it is desirable that the injection time of any of the fuel injectors be readily determined with no need to adapt the test instrument 10 to the particular type of fuel injector being measured.

Figure 2:
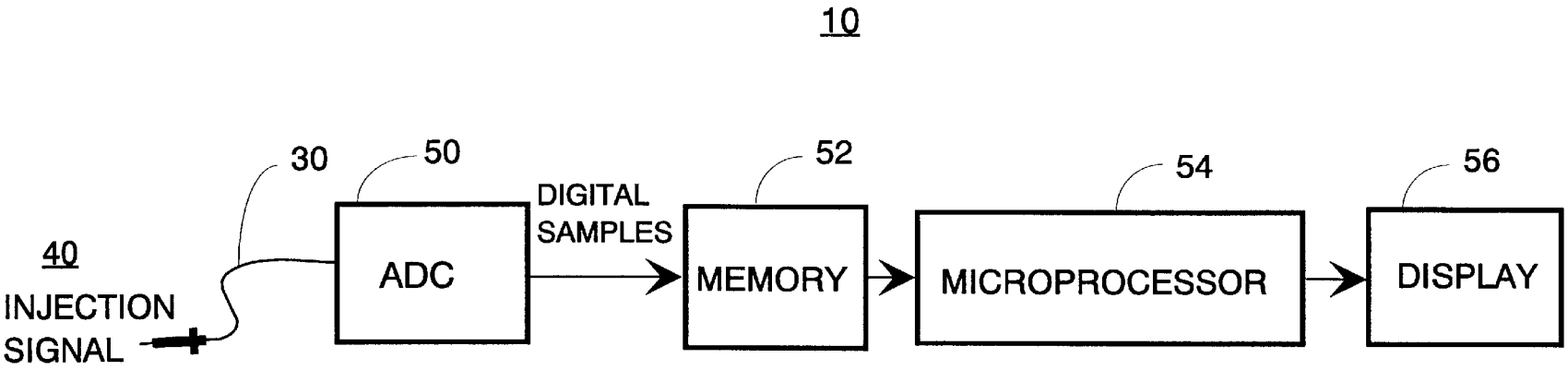
FIG. 2 is a simplified block diagram of the test instrument of FIG. 1.

FIG. 2 is a simplified block diagram of the test instrument 10 operating according to the present invention. An injection signal 40 is coupled via the voltage probe 30 to an analog to digital converter (ADC) 50 which converts the injection signal 40 to a stream of digital samples. An output of the ADC 50 is coupled to a memory 52 which stores the stream of digital samples in a time-ordered manner that preserves the waveshape of the injection signal for later analysis. The ADC 50 samples the injection signal 40 at a sample rate and a sample resolution to accurately reconstruct the waveshape in the memory 52 and over a measurement time period long enough to include at least one complete injection pulse.

A microprocessor 54 is coupled to the memory 52 to receive the stored digital samples and determine the injection time using an algorithm according to the present invention. The injection time results, along with the waveshape of the injection signal 40, may then be coupled to the display 56 for visual display.

Figure 3:
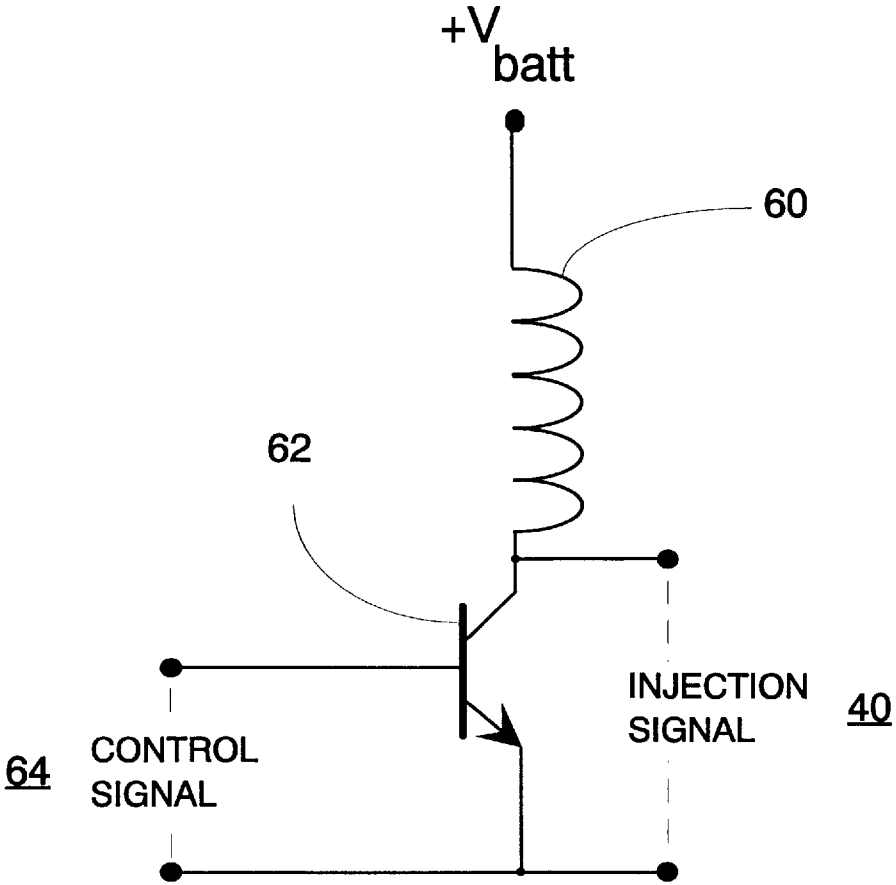
FIG. 3 is a schematic drawing of a typical fuel injector coil and associated switch which develops an injection signal.

FIG. 3 is a schematic diagram of a fuel injector coil 60 coupled in series with a switching transistor 62. The switching transistor 62 switches on and off in response to a control signal 64. Other switching elements, such as field effect transistors (FET's) may readily be substituted for the bipolar transistor shown as the switching transistor 62. The series combination of fuel injector coil 60 and switching transistor 62 is coupled between a battery voltage Vbatt and ground.

The voltage developed between the fuel injector coil 60 and ground is the injection signal 40.

Figure 4:
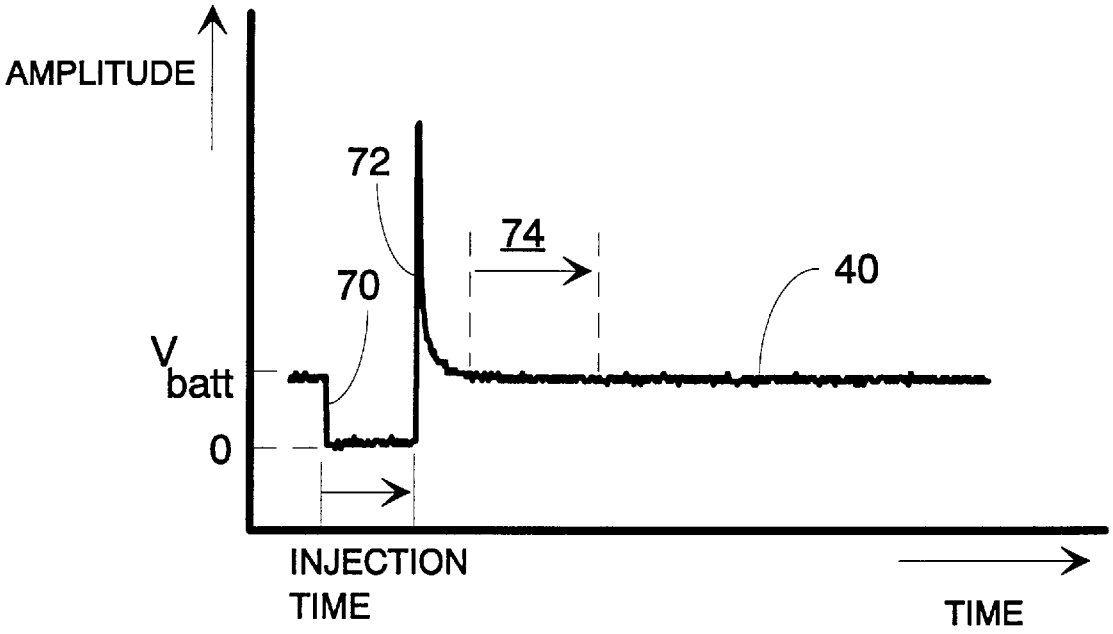
FIG. 4 is a graphical plot of the injection signal according to a first type of fuel injector.

FIG. 4 is a graphical representation of the injection signal 40 shown in the form of an amplitude versus time plot representing the image formed by the digital samples in the memory 52. The waveshape as shown is that of a saturated driver fuel injector in which the switching transistor 62 remains 'on' or saturated for the duration of the injection time. The saturated driver fuel injector is the simplest type in which to determine injection time because there are no false edges that would otherwise interfere with the measurement.

In the method of the present invention, an edge is defined as a voltage transition exceeding a minimum step size equal to 80% of the battery voltage in less than a predetermined step time. In the preferred embodiment, the predetermined step time is 40 microseconds or roughly two adjacent samples at the sample rate of 500,000 samples per second.

The first edge is defined as a negative going voltage transition exceeding the predetermined step size. The second edge is defined as positive going voltage transition exceeding the predetermined step size and followed by a voltage level substantially equal to the battery voltage Vbatt exceeding a hold time. The positive voltage peak following the second edge is caused by the inductive reactance of the fuel injector coil 60 which occurs whenever the switching transistor 62 is opened. Additional circuitry within the fuel injector circuit to clamp or limit the peak voltage developed by the fuel injector coil 60 may be added without affecting the operation of the present invention. The hold time is a predetermined amount of time that is chosen to optimally distinguish the desired second edges from the undesirable false edges and may be arrived at by a reasonable amount of experimentation based on the maximum expected repetition rate of the injection signal 40.

In FIG. 4, a first edge 70 is found as a negative going voltage transition of a level exceeding the predetermined step size in less than the predetermined step time. A second edge 72 is found as a positive going voltage transition followed by a voltage substantially equal to Vbatt exceeding a hold time 74. The injection time is then determined from the time difference between first edge 70 and second edge 72.

Figure 5:
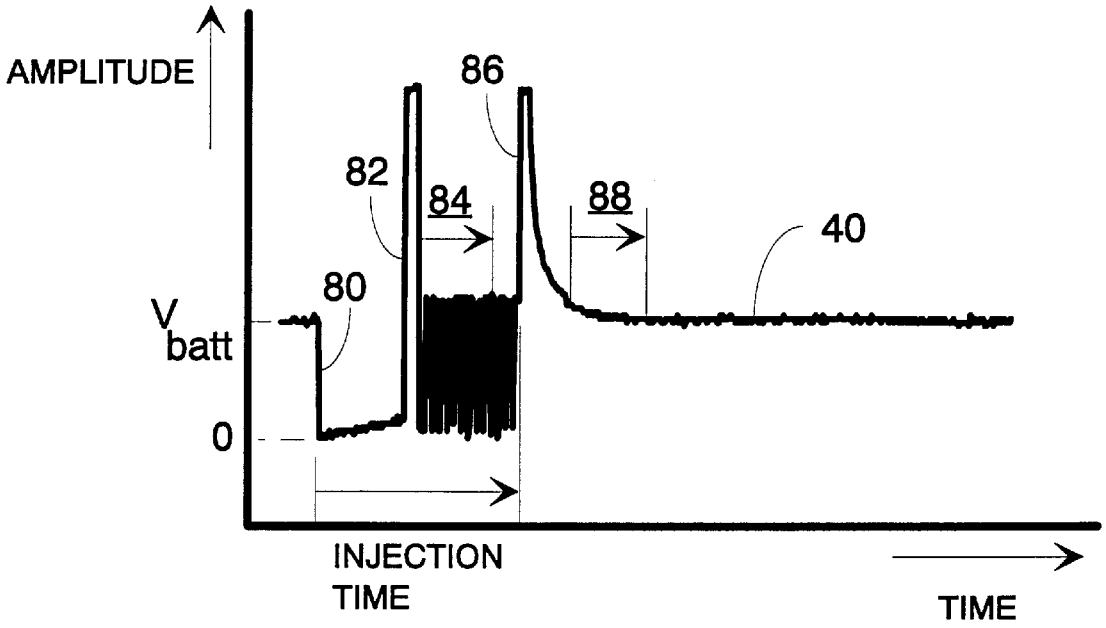
FIG. 5 is a graphical plot of the injection signal according to a second type of fuel injector.

FIG. 5 is a graphical representation of the injection signal 40 shown in the form of an amplitude versus time plot representing the waveshape of a modulated driver fuel injector. A first edge 80 is found as a negative going voltage transition of a level exceeding the predetermined step size in less than the predetermined step time. Following the first edge 80, the switching transistor 62 remains 'on' long enough to open the fuel injector but then turns off to obtain a false edge 82 followed by a period of modulation which holds the fuel injector open but with less power dissipated in the injector coil 60.

The modulation characteristics are determined by the control signal 64 that is applied to the transistor 62 which is in accordance with the industry standards for modulated driver fuel injectors. Because the false edge is not followed by a voltage that is substantially close to Vbatt for a hold time 84, the false edge 82 is rejected in favor of a second edge 86 which is followed by a voltage that is substantially close to Vbatt for a hold time 88. The injection time is then properly determined from the time difference between the first edge 80 and the second edge 86.

Figure 6:
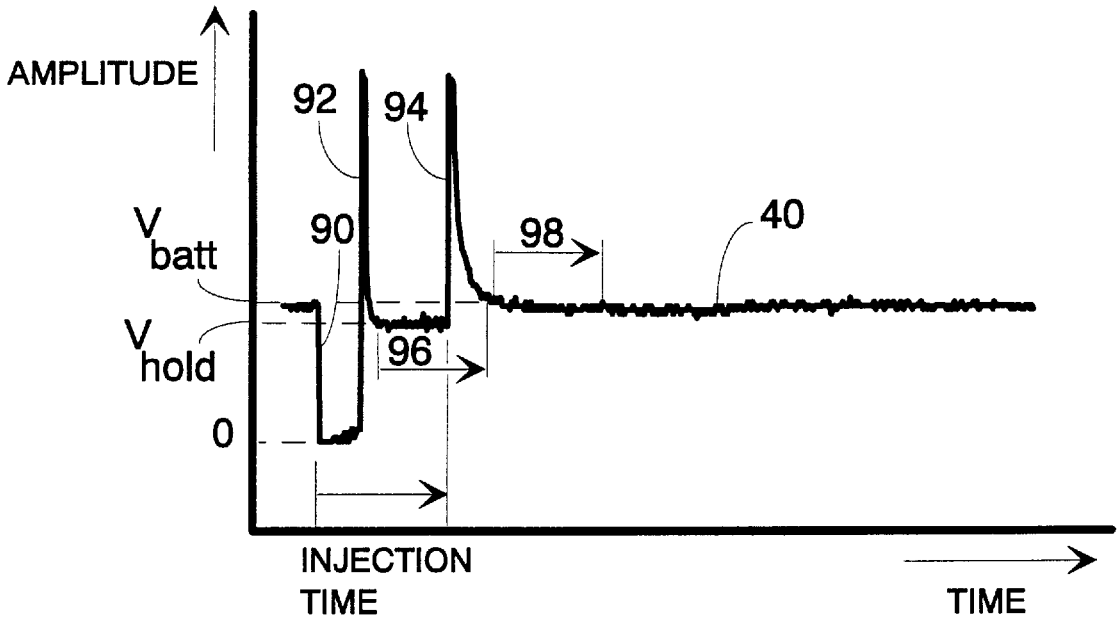
FIG. 6 is a graphical plot of the injection signal according to a third type of fuel injector.

FIG. 6 is a graphical representation of the injection signal 40 shown in the form of an amplitude versus time plot representing the waveshape of a peak and hold driver fuel injector. A first edge 90 is found as a negative going voltage transition of a level exceeding the predetermined step size. Following the first edge 90, the switching transistor 62 remains 'on' long enough to open the fuel injector but then turns off to obtain a false edge 92 followed by a period of current limiting which holds the fuel injector open but with less power dissipated in the injector coil 60. The voltage level during this period remains at Vhold but which is not substantially different from the voltage level Vbatt. Because the false edge 92 is followed by a second edge 94 within a hold time 96, the false edge 92 is rejected in favor of the second edge 94. The injection time is then properly determined from the time difference between the first edge 90 and the second edge 94.

Figure 7:
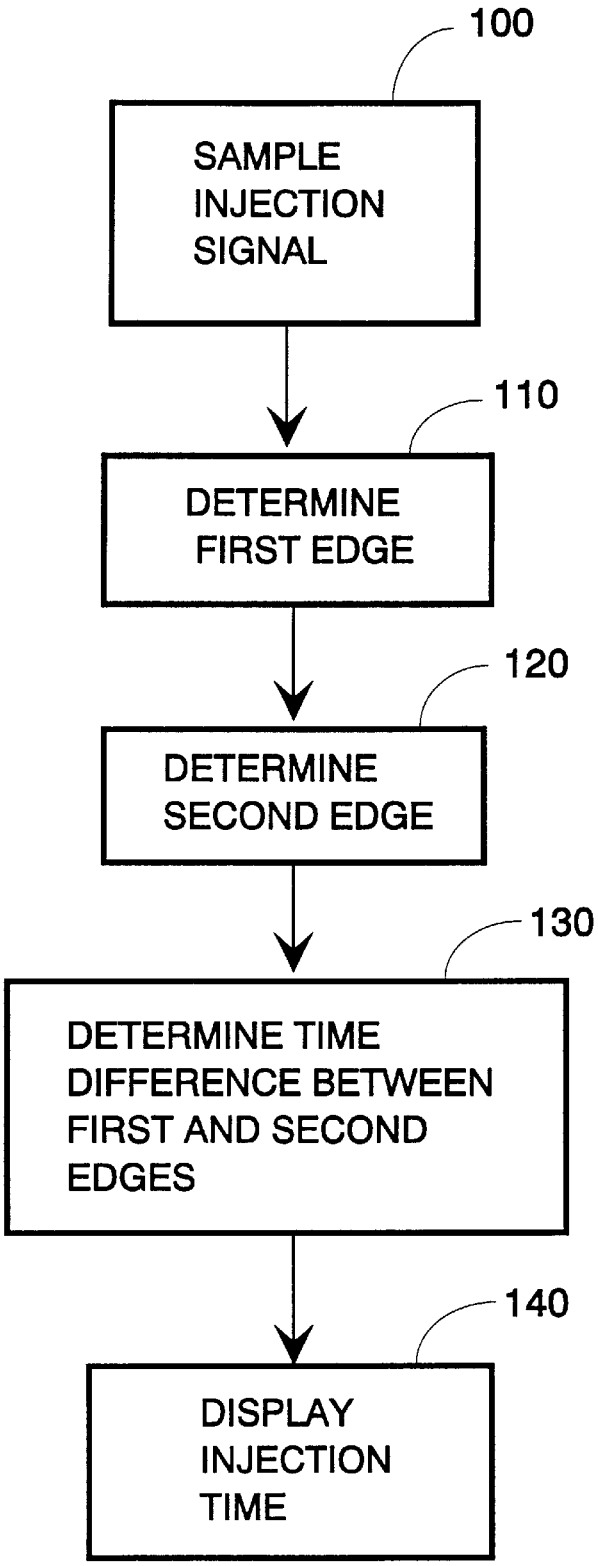
FIG. 7 is a simplified flow diagram of the method of obtaining the injection time according to the present invention.

FIG. 7 is a flow diagram describing the operation of the test instrument 10 according to the method of the present invention described in detail above. In step 100 labeled SAMPLE INJECTION SIGNAL, the injection signal 40 is coupled to the test instrument 10 to be sampled by the ADC 50 and the digital samples from the ADC 50 are stored as a time-ordered array in the memory 52 (shown in FIG. 2).

In the step 110 labeled DETERMINE FIRST EDGE, the microprocessor 54 operates on the digital samples stored in the memory 52 to determine the first edge encountered in the injection signal 40. The first edge is defined as a negative going voltage transition exceeding the predetermined step size in less than the predetermined step time.

In the step 120 labeled DETERMINE SECOND EDGE, the microprocessor 54 operates on the digital samples stored in the memory 52 to determine the second edge encountered in the injection signal 40. The second edge is defined as a positive going voltage transition exceeding 80% of the battery voltage Vbatt according to the predetermined step size in less than the predetermined step time followed by a voltage at approximately the battery voltage Vbatt exceeding the hold time. At the same time, any intervening false edges that occur before the second edge may be rejected according to this criteria.

In the step 130 labeled DETERMINE TIME DIFFERENCE BETWEEN FIRST AND SECOND EDGES, the time difference between the first and second edges are determined based on their location in the time-ordered data of the memory 52. The time difference represents the injection time which is the total amount of time the fuel injector valve remains open, allowing fuel to flow through it.

In the step 140 labeled DISPLAY INJECTION TIME, the time difference determined in the process 130 may be visually displayed in a format useful for the application. For example, the time difference may be displayed numerically for the present value. The time difference may also be displayed graphically, such as a series of time differences gathered over a selected period of time. The injection time may be incorporated into other measurements, such as duty cycle, which are calculated results requiring numerical data to operate on.

It will be obvious to those having ordinary skill in the art that many changes may be made in the details of the above described preferred embodiments of the invention without departing from the spirit of the invention in its broader aspects. For example, the predetermined voltage level and predetermined time may be readily changed to better discriminate edges based on improved knowledge of the injection signal likely to be encountered. The first and second edges may be readily redefined according to different configurations of fuel injector types. For example, the first edge may be re-defined as a positive transition and the second edge re-defined as a negative transition for a fuel injector type having a switching transistor coupled to the battery voltage rather than ground, which is commonly referred to as high side switching. Therefore, the scope of the present invention should be determined by the following claims.

What I claim as my invention is:

1. A test instrument for measuring injection time of a fuel injector for an internal combustion engine, comprising:

(a) a voltage probe coupled to said fuel injector for receiving an injection signal;

(b) a digitizer adapted for converting said injection signal to digital samples;

(c) a memory coupled to said digitizer for storing said digital samples;

(d) a microprocessor coupled to said memory for receiving said digital samples, determining from said digital samples a first edge and a second edge of said injection signal while rejecting false edges, and further determining an injection time from said first edge and said second edge; and (e) a display for visually displaying said injection time.

2. A test instrument for measuring an injection time according to claim 1 wherein said first edge comprises a negative going voltage transition of said injection signal exceeding a predetermined step size in less than a predetermined step time.

3. A test instrument for measuring an injection time according to claim 2 wherein said second edge comprises a positive going voltage transition of said injection signal exceeding said predetermined step size in less than said predetermined step time followed by said injection signal being substantially equal to a battery voltage exceeding a hold time.

4. A test instrument for measuring an injection time according to claim 3 wherein said predetermined step size is approximately equal to eighty percent of said battery voltage.

5. A test instrument for measuring an injection time according to claim 3 wherein said predetermined step time is approximately equal to forty microseconds.

6. A test instrument for measuring an injection time according to claim 3 wherein said hold time is chosen to optimally discriminate between said false edges and said second edge.

7. A test instrument for measuring an injection time according to claim 1 wherein said digitizer further comprises an analog to digital converter.

8. A test instrument for measuring an injection time according to claim 1 wherein said fuel injector comprises one of a plurality of types including a saturated driver injector, a modulated driver injector, and a peak and hold driver injector.

9. In a test instrument for measuring an injection signal from a fuel injector for an internal combustion engine, a method for determining injection time from said injection signal, comprising:

(a) receiving said injection signal from said fuel injector;

(b) digitizing said injection signal to obtain digital samples;

(c) storing said digital samples in a memory as a time-ordered array;

(d) determining a first edge of said injection signal from said time-ordered array;

(e) determining a second edge of said injection signal from said time-ordered array while rejecting false edges; and (f) calculating said injection time according to said first edge and said second edge.

10. A method for determining injection time according to claim 9 further comprising displaying said injection time.

11. A method for determining injection time according to claim 9 further comprising determining said first edge wherein said injection signal has a negative going voltage transition exceeding a predetermined step size in less than a predetermined step time.

12. A method for determining injection time according to claim 11 further comprising determining said second edge wherein said injection signal has a positive going voltage transition exceeding said predetermined step size in less than said predetermined step time followed by said injection signal being substantially equal to a battery voltage for a period of time exceeding a hold time.

13. A method for determining injection time according to claim 12 wherein said predetermined step size is approximately equal to eighty percent of said battery voltage.

14. A method for determining injection time according to claim 12 wherein said predetermined step time is approximately equal to forty microseconds.

15. A method for determining injection time according to claim 12 wherein said hold time is chosen to optimally discriminate between said false edges and said second edge.

16. A method for determining injection time according to claim 9 further comprising digitizing said injection signal with an analog to digital converter.

17. A method for determining injection time according to claim 9 wherein said fuel injector comprises one of a plurality of types including a saturated driver injector, a modulated driver injector, and a peak and hold driver injector.

* * * * *